US006808059B2

(12) United States Patent
Nagai et al.

(10) Patent No.: US 6,808,059 B2
(45) Date of Patent: Oct. 26, 2004

(54) APPARATUS FOR REMOVING ROD-LIKE ARTICLES

(75) Inventors: Junichi Nagai, Tokyo (JP); Takayuki Irikura, Kohriyama (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 10/739,343

(22) Filed: Dec. 19, 2003

(65) Prior Publication Data

US 2004/0129531 A1 Jul. 8, 2004

Related U.S. Application Data

(63) Continuation of application No. PCT/JP02/06023, filed on Jun. 17, 2002.

(30) Foreign Application Priority Data

Jun. 19, 2001 (JP) ..... 2001-185267

(51) Int. Cl.[7] ..... B65G 47/10

(52) U.S. Cl. ..... 198/370.11; 198/370.12; 198/471.1; 131/907

(58) Field of Search ..... 198/370.11, 370.12, 198/438, 471.1; 131/907

(56) References Cited

U.S. PATENT DOCUMENTS 4,452,255 A * 6/1984 Brand ..... 198/438
4,825,994 A * 5/1989 Gomann et al. ..... 198/370.12
5,232,079 A * 8/1993 Belcastro et al. ..... 198/370.11
5,329,945 A * 7/1994 Irikura et al. ..... 131/907
5,490,527 A * 2/1996 Irikura et al. ..... 131/907
6,142,289 A * 11/2000 Dombek ..... 198/471.1

* cited by examiner

*Primary Examiner*—Joseph Valenza
(74) *Attorney, Agent, or Firm*—Birch, Stewart, Kolasch & Birch, LLP

(57) ABSTRACT

A removing apparatus for rod-like articles comprises a removing drum (24) as part of a transport path for the articles such as cigarettes, double filter cigarettes and filter cigarettes in a filter cigarette manufacturing machine, and many transport grooves (48) formed on the outer circumferential surface of the drum (24) for receiving the articles. Adjacent grooves (48) have suction holes (52) at different axial positions thereof. While passing through a suction holding region (A) of the removing drum (24), the adjacent transport grooves (48) receive holding pressure for the articles, from the corresponding holding passages (68) of the region (A) through the suction holes (52). The passages (68) extend longer than the pitch of the transport grooves (48). When compressed air is supplied to a passage (68), the passage (68) allows the compressed air to blow out from connected suction holes (52) to thereby remove the article from the corresponding transport groove (48).

8 Claims, 8 Drawing Sheets

APPARATUS FOR REMOVING ROD-LIKE ARTICLES

This application is a Continuation of PCT International Application No. PCT/JP02/06023 filed on Jun. 17, 2002, which designated the United States, and on which priority is claimed under 35 U.S.C. §120 and this Nonprovisional application claims priority under 35 U.S.C. §119(a) on Patent Application No(s). 2001-185267 filed in Japan on Jun. 19, 2001, the entire contents of which are hereby incorporated by reference.

TECHNICAL FIELD

The invention relates to a removing apparatus for removing defective rod-like articles from a transport path while rod-like articles are being transported along the transport path, particularly to a removing apparatus suited for a filter cigarette manufacturing machine.

BACKGROUND ART

A filter cigarette manufacturing machine has a transport drum train comprising rotatable transport drums. The transport drums are adjacent to each other and form a transport path for rod-like articles such as cigarette rods and filter plugs which are used in manufacturing filter cigarettes. While cigarette rods and filter plugs are transported along the transport path, various steps for forming filter cigarettes from the cigarette rods and filter plugs are carried out sequentially.

Specifically, while the cigarette rods are transported, each cigarette rod is cut into two equal cigarettes, and then a filter plug is supplied to between those two cigarettes. The cigarettes and filter plug are connected by a tip-paper piece to form a double filter cigarette, and then the double filter cigarette is cut into two equal filter cigarettes.

Among the transport drums in the transport drum train, at least one transport drum functions as a removing drum. When rod-like articles, namely, cigarettes, double filter cigarettes or filter cigarettes pass across the removing drum, the removing drum removes them from the transport path. This is performed in order to sample rod-like articles or prevent defective rod-like articles from being transported in the downstream side of the removing drum.

Like the other transport drums in the transport drum train, the removing drum has many transport grooves on its outer circumferential face. As the removing drum rotates, rod-shaped articles are transported, being held in the transport grooves by suction pressure. More specifically, the removing drum has a suction supply region which extends in the circumferential direction thereof, and each transport groove has a plurality of suction holes for receiving suction pressure from the suction supply region. Hence, each transport groove can receive suction pressure through its suction holes while the transport groove is passing through the suction supply region extending in the circumferential direction of the removing drum.

In the suction supply region, a suction holding region is so arranged that the suction holding region severs the suction supply region. While the suction holding region can normally supply the transport grooves with suction pressure enough to suck and thereby hold rod-like articles in the transport grooves, it can selectively receive compressed air from a compressed air ejecting means.

Specifically, when a rod-like article which should be sampled or removed passes through the suction holding region, being held in a transport groove, compressed air is supplied to the suction holding region from the compressed air ejecting means. The compressed air negates the suction pressure and removes the rod-like article from the transport groove.

In order to improve the production capacity of the filter cigarette manufacturing machine, the speed at which rod-like articles are transported along the transport path, accordingly, the speed at which the removing drum rotates tends to be more increased. In this case, since each transport groove passes through the suction holding region in a shorter time, the compressed air ejecting means for selectively supplying compressed air to the suction holding region, more specifically, a removing valve thereof needs to be switched over more quickly.

However, even if the removing valve itself can be switched over at a high speed, it is impossible to generate a desired compressed-air pressure, or a desired removing pressure in the suction holding region immediately after the removing valve is switched over, because of the compressibility of air. Response delay in generating the removing pressure is unavoidable.

In order to deal with this response delay, it is thinkable to broaden the suction holding region in the removing-drum circumferential direction to make the time in which the removing pressure is supplied longer. In this case, however, when a transport groove holding a rod-like article to be sampled or removed is still in the suction holding region, the subsequent transport groove comes in the suction holding region. Thus, the removing pressure supplied to the suction holding region removes also a rod-like article in the subsequent transport groove at the same time.

Further, when a transport groove not holding a rod-like article comes in the suction holding region, the pressure in the suction holding region increases to the atmospheric pressure through the suction holes of this empty transport groove. In this case, the transport grooves immediately before and after the empty transport groove cannot receive enough suction pressure from the suction holding region, so that rod-like articles fall off these transport grooves.

DISCLOSURE OF THE INVENTION

An object of the invention is to provide a removing apparatus which allows high-speed rotation of the removing drum, ensuring that rod-like articles are removed only from intended transport grooves.

In order to attain the above object, a removing apparatus for rod-like articles according to the invention comprises a rotatable removing drum forming part of a transport path for rod-like articles, a suction means, a suction holding region, and a compressed air ejecting means.

The removing drum has a plurality of transport grooves for each receiving a rod-like article. The transport grooves are arranged at an outer circumferential surface of the removing drum with equal spaces between them in the circumferential direction thereof, and each have a suction hole, where each of the transport grooves has its suction hole at a different axial position of the transport groove than a transport groove adjacent to the transport groove in the circumferential direction of the removing drum has, so that the transport grooves are classified into a plurality of transport-groove types according to the position of the suction hole.

The suction means includes a suction supply region extending in the circumferential direction of the removing drum. The suction means is so provided as to supply suction pressure to the transport grooves through their suction holes while the transport grooves are passing through the suction supply region when the removing drum is rotating, to hold rod-like articles in the transport grooves by suction.

The suction holding region severs the suction supply region. The suction holding region has a plurality of independent holding passages each associated with one of the transport-groove types. The holding passages are arranged in parallel and each extend longer in the removing-drum circumferential direction than the distance between the transport grooves. The holding passages are so provided that the holding passages are each connected to the suction holes of transport grooves of their associated transport-groove type while the transport grooves are passing through the suction holding region, to thereby supply predetermined holding pressure to the transport grooves of their associated transport-groove type through the suction holes to hold suction of the rod-like articles in the transport grooves.

The compressed air ejecting means is provided for selectively removing rod-like articles from the transport grooves by compressed air while the transport grooves are passing through the suction holding region. The compressed air ejecting means comprises a plurality of independent supply passages each associated with one of the transport-groove types. The supply passages are so provided as to supply compressed air to the transport grooves while the transport grooves are passing through the suction holding region, to thereby negate suction of rod-like articles in the transport grooves. The supply passages are opened and closed by solenoid-operated valves.

Specifically, the removing drum includes a stationary sleeve member having the suction holding region on its outer circumferential surface, and a drum shell rotatably mounted on the outer circumferential surface of the stationary sleeve member and having the transport grooves.

In the above-described removing apparatus, while a transport groove holding a rod-like article to be removed is passing through the suction holding region, the compressed air ejecting means supplies compressed air to that particular transport groove. The supplied compressed air negates the suction of the rod-shaped article which is effected by the holding pressure in the holding passage associated with the transport-groove type of that particle transport groove. Thus, the rod-like article is removed from the transport groove.

After the rod-like article is removed from the transport groove, the holding passage associated with the transport-groove type of that transport groove is open to the atmosphere through the suction hole of that transport groove. However, the holding pressure in the holding passages associated with the other transport-groove types are maintained although the rod-like article was removed. Since the suction holding region is longer than the pitch between the transport groves, the subsequent transport groove comes in the suction holding region while the transport groove from which the rod-like article was removed is still in the suction holding region. Even so, the subsequent transport groove can move into the suction holding region, stably holding a rod-like article by suction.

When an empty transport groove comes in the suction holding region, the passage associated with the transport-groove type of that empty transport groove is open to the atmosphere through the suction hole of that empty transport groove. However, also in this case, the holding pressure in the passages associated with the other transport-groove types are maintained. Hence, the subsequent transport groove can move into the suction holding region, stably holding a rod-like article by suction.

As mentioned above, the suction holding region extends longer in the removing-drum circumferential direction than the pitch between the transport grooves. This means that the time in which compressed air, or in other words, removing pressure is supplied from the compressed air ejecting means to a transport groove is correspondingly long. Hence, even if there is response delay in raising the removing pressure, high-speed rotation of the removing drum is allowed, ensuring that rod-articles are removed reliably.

The supply passages are each connected with the holding passage associated with the same transport-groove type. In this case, a rod-like article in a transport groove is removed by compressed air which is ejected from the associated holding passage through the suction hole.

The compressed air ejecting means may includes ejecting holes formed in the transport grooves, and a plurality of independent ejecting grooves each associated with one of the transport-groove types. The ejecting holes are located at different axial positions of the transport groove, depending on the transport-groove types. The spurting grooves extend in parallel with the holding passages in the suction holding region and are each connected with the supply passage associated with the same transport-groove type. The ejecting grooves are so provided that the ejecting grooves are each connected to the ejecting holes of transport grooves of their associated transport-groove type while the transport grooves are passing through the suction holding region.

When the above-described compressed air ejecting means is provided, a rod-like article in a transport groove is removed by compressed air which is ejected from the associated ejecting groove through the ejecting hole into the transport groove.

The compressed air ejecting means may further include connection holes each connecting a holding passage and an ejecting groove associated with the same transport-groove type. In this case, a rod-like article in a transport groove is removed by compressed air which is ejected through not only the ejecting hole but also the suction hole.

The suction means may include a plurality of suction slots formed in the outer circumferential surface of the stationary sleeve member. The suction slots extend in the suction supply region and are connectable with the suction holes of the transport grooves. The suction holding region further includes connection passages connecting each of the holding passages with an associated one of the suction slots. In this case, the holding pressure in each holding passage comes from the suction pressure in the associated suction slot.

Each connection passage may have a throat for determining the holding pressure in its associated holding passage. The throat produces holding pressure in the holding passage, which is weaker than the suction pressure in the associated suction slot. This makes it possible to remove a rod-like article with a low-pressure compressed air. Thus, the compression air ejecting means may supply low-pressure compressed air to a transport groove.

The removing drum may form part of a transport path in a filter cigarette manufacturing machine, and be provided for removing cigarettes, double filter cigarettes or filter cigarettes transported along the transport path as rod-like articles.

BEST MODE OF CARRYING OUT THE INVENTION

Figure 1:
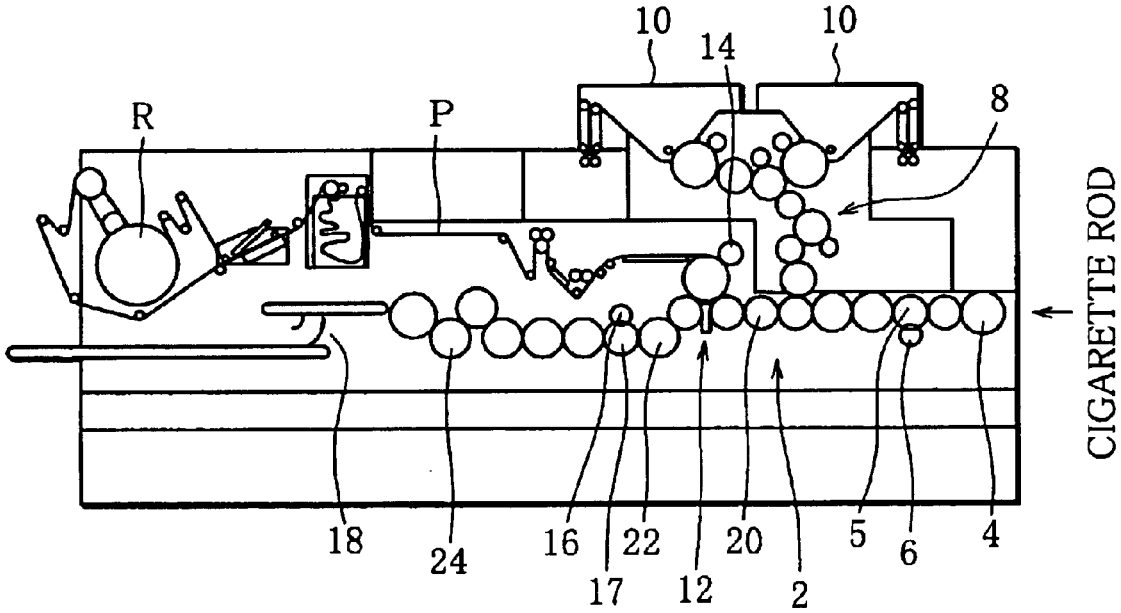
FIG. 1 is a schematic illustration showing a filter cigarette manufacturing machine.

A filter cigarette manufacturing machine shown in FIG. 1 has a transport drum train 2 which extends horizontally. The transport drum train 2 comprises many transport drums which are adjacent to each other in a line. Each of the transport drums is rotated in the direction opposite to the direction in which a transport drum adjacent to the drum is rotated.

As the transport drums in the transport drum train 2 rotate, the transport drum at the right end of the transport drum train 2 in FIG. 1, namely, the receiving drum 4 receives a cigarette rod CR which is supplied from a cigarette manufacturing machine (not shown). The cigarette rod CR received by the receiving drum 4 is transported in the manner that the rod CR is transferred from one to the immediate left one of the transport drums. Thus, the transport drum train 2 forms a transport path for cigarette rods CR.

A transport drum 5 located on the receiving drum 4 side of the transport drum train 2 has a rotary knife 6. On the transport drum 5, the rotary knife 6 cuts a cigarette rod CR into two equal cigarettes C. Thus, the downstream side of the transport drum 5, the two cigarettes C are transported on the transport drum train 2. During this transportation, the two cigarettes C are set apart, and a predetermined space is produced between the two cigarettes C.

Another transport drum train 8 extends upward from the transport drum train 2. The transport drum train 8 divides into two upper parts, which are each connected to a hopper 10. A lot of filter rods are stored in each of the two hoppers 10.

The transport drum train 8 takes filter rods one by one from each of the hoppers 10 and transports the filter rods toward the transport drum train 2. During this transportation, cutting, aligning and the like are performed on the filter rods to form them into individual filter plugs FP. Then, each of the filter plugs FP is supplied from the transport drum train 8 to between two cigarettes C on the transport drum train 2. On the transport drum train 2, the two cigarettes are shifted to be in close contact with the opposite ends of the filter plug FP.

The transport drum train 2 has a rolling section 12. The rolling section 12 is located the downstream of the transport drum train 8. In addition to the two cigarettes C and one filter plug FP, a tip paper piece T is supplied to the rolling section 12. On one side of the tip-paper piece T, glue is already applied. In the rolling section 12, the tip-paper piece T is wrapped around the two cigarettes C and one filter plug FP to connect the two cigarettes C with the filter plug FP. Thus, a double filter cigarette DFC is formed.

Tip-paper pieces T are prepared by cutting tip paper web P into pieces of a predetermined length with a rotary knife 14. The tip paper web P is drawn out from a paper roll R. On the path along which the tip paper web P is drawn out is provided a glue application device. The glue application device applies glue onto one side of the tip paper web P.

From the rolling section 12, the double filter cigarette DFC is transported the downstream of the transport drum train 2. The downstream part of the transport drum train 2 includes a transport drum 17 having a rotary knife 16. When the double filter cigarette DFC is transported on the transport drum 17, the rotary knife 16 cuts the double filter cigarette DFC into two equal filter cigarettes FC.

Figure 2:
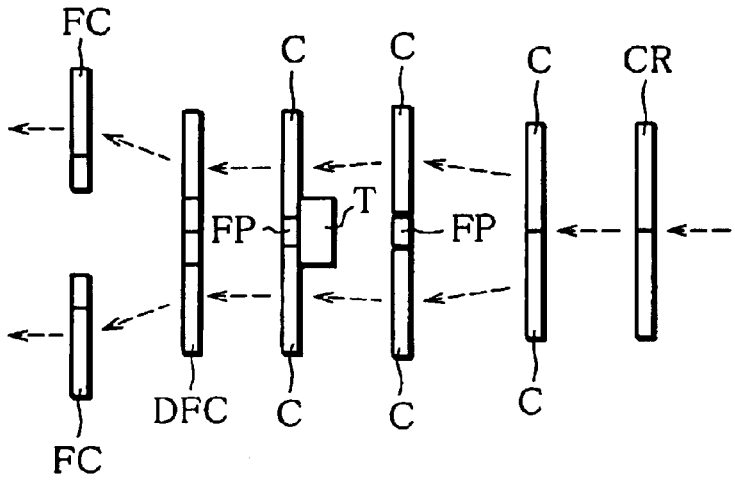
FIG. 2 is a schematic illustration showing a process of forming filter cigarettes.

FIG. 2 helps understand the above-described process of manufacturing double filter cigarettes DFC more clearly.

After the above step, in the downstream part of the transport drum line 2, the left and right filter cigarettes FC are shifted to be apart from each other, and then supplied to an arrangement conveyor 18 from a terminal end of the transport drum train 2. The arrangement conveyor 18 arranges the left and right filter cigarettes FC to orient in the same direction and transports to a packaging machine (not shown).

In the transport drum train 2, some transport drums function as removing drums 20, 22 and 24. As seen from FIG. 1, the removing drum 20 is located immediately downstream of the transport drum train 8, and the removing drum 22 is located immediately upstream of the transport drum 17. The removing drum 24 is a transport drum which is adjacent to the transport drum located at the terminal end of the transport drum train 2. The transport drums located immediately upstream of the removing drums 20, 22, 24 function as inspection drums, respectively.

The removing drums 20, 22, 24 are basically similar in structure. Hence, only the removing drum 24 will be explained. As seen from FIG. 2 which shows the manufacturing process, the removing drums 20 or 24 transports cigarettes C or filter cigarettes FC in two line, respectively, while the removing drum 22 transports double filter cigarettes DF in one line.

Figure 3:
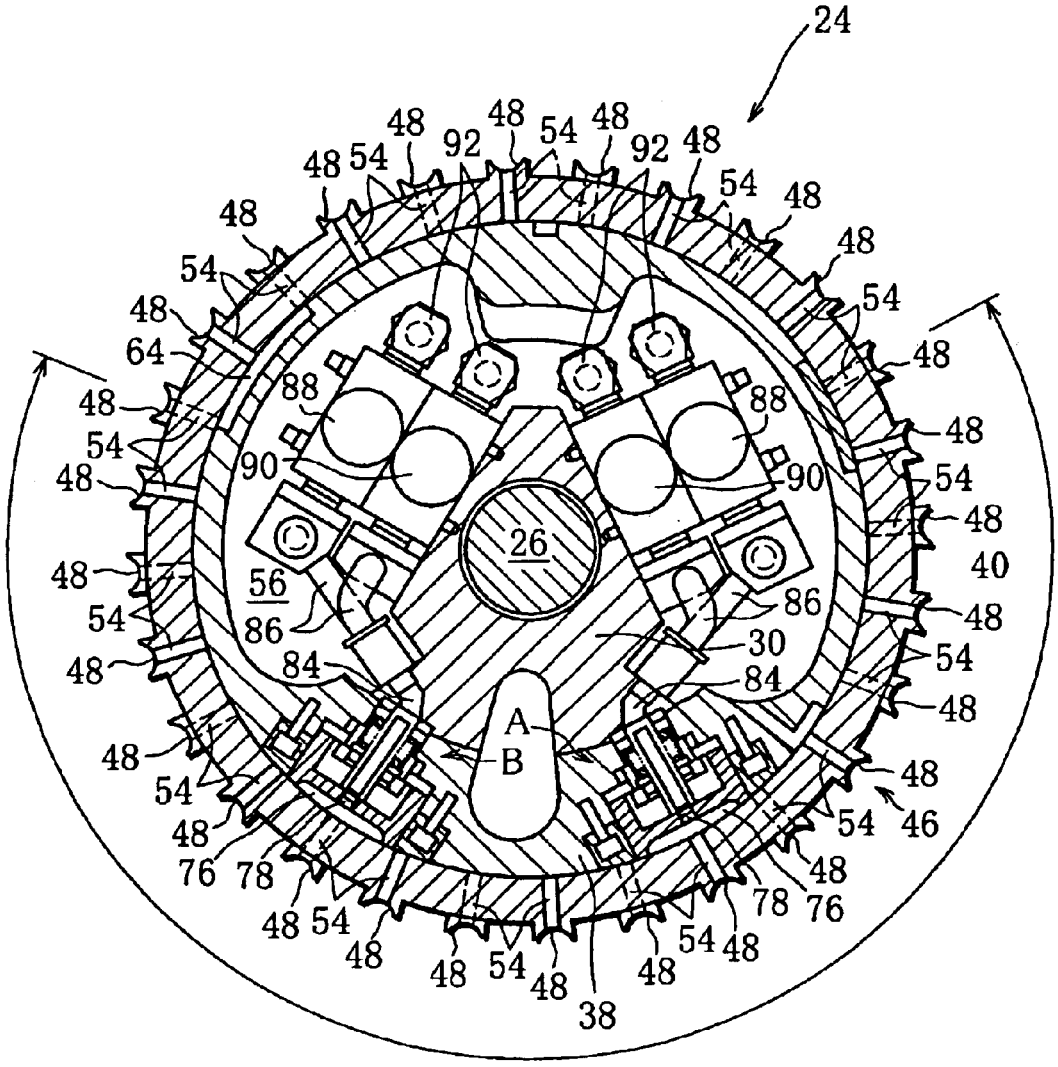
FIG. 3 is a detailed cross-sectional view of a removing drum of FIG. 1.
Figure 4:
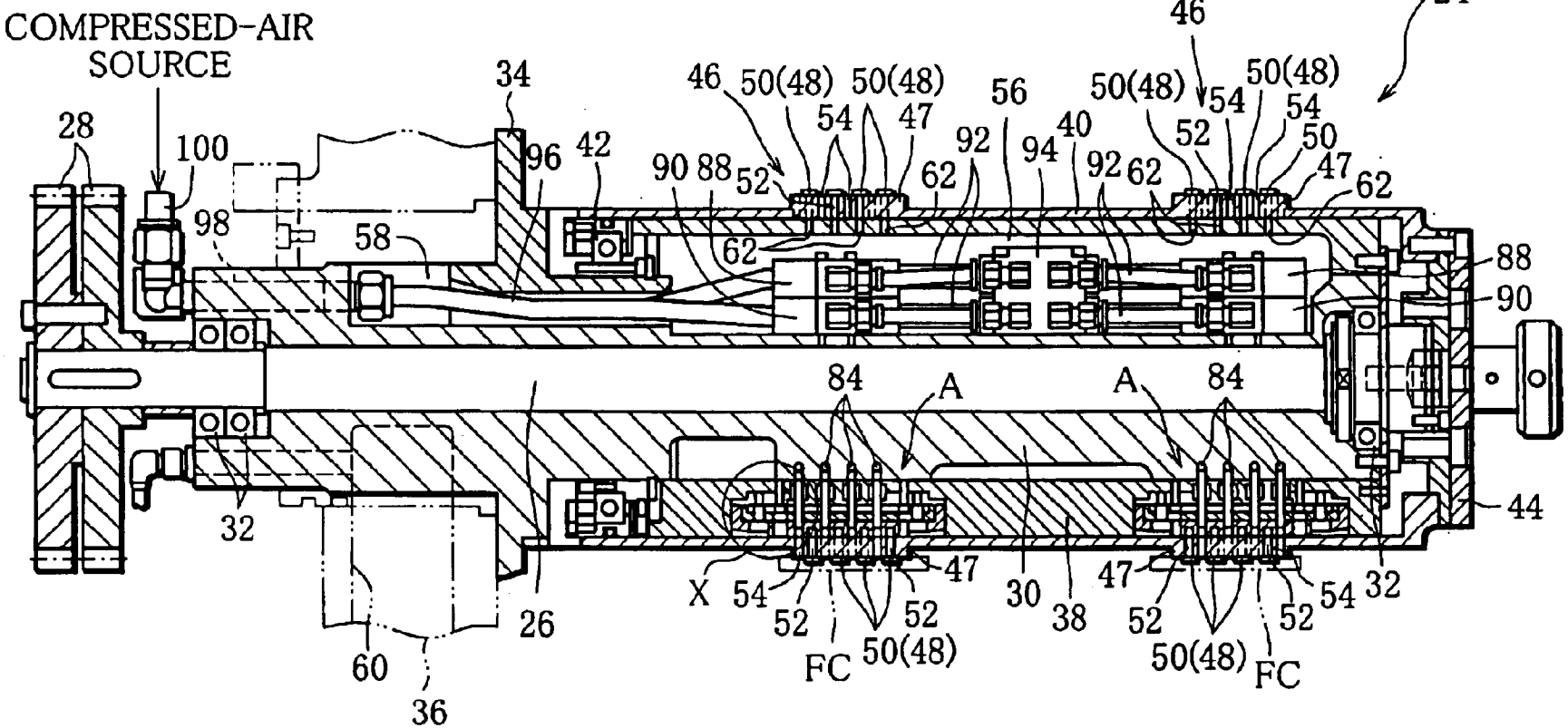
FIG. 4 is a longitudinal cross-sectional view of the removing drum of FIG. 3.

As shown in FIGS. 3 and 4, the removing drum 24 has a driving shaft 26. The driving shaft 26 is arranged on the axis of the removing drum 24. An one end of the driving shaft 26, is connected to a power transmission system (not shown) through gear pulleys 28. An inner sleeve 30 is arranged around the driving shaft 26 with a predetermined gap (see FIG. 3) between the inner sleeve 30 and the driving shaft 26.

The inner sleeve 30 extends along the driving shaft 26. An one end of the inner sleeve 30 is fixed to a frame 36 of the manufacturing machine by a flange 34. Bearings 32 are provided at the opposite ends of the inner sleeve 30, between the inner sleeve 30 and the driving shaft 26. The bearings 32 rotatably support the driving shaft 26.

Around the inner sleeve 30 is provided an outer sleeve 38. The outer sleeve 38 is integrally connected with the other end of the inner sleeve 30.

Around the outer sleeve 38 is provided a drum shell 40. The drum shell can rotate while sliding on the outer circumferential surface of the outer sleeve 38 and keeping airtight contact with the outer sleeve 38. Specifically, the drum shell 40 extends beyond either end of the outer sleeve 38. An one end of the drum shell 40 is rotatably mounted on the inner sleeve 30 by means of a bearing 42, while the other end of the drum shell 40 is connected to the other end of the driving shaft 26.

As shown in FIG. 4, the other end of the driving shaft 26 extends beyond the inner sleeve 30, and is connected with the other end of the drum shell 40 by means of a connecting disc 44. Hence, the drum shell 40 and the driving shaft 26 rotate in an integrated manner.

The outer circumferential surface of the drum shell 40 has two transport-groove rows 46. The two transport-groove rows 46 are apart from each other in the axial direction of the drum shell 40. As shown in FIG. 4, each transport-groove row 46 is formed on a rib 47 raised from the outer circumferential surface of the drum shell 40. The ribs 47 extend in the circumferential direction of the drum shell 40. Many transport grooves are formed on each of the ribs 24 in a protruding manner. The transport grooves 48 are arranged in the circumferential direction of the drum shell 40 with equal spaces between.

As shown in FIG. 4, each transport grove 48 is divided into four groove-parts 50. The four groove-parts 50 are arranged in the axial direction of the drum shell 40 with predetermined spaces therebetween. Each transport groove 48 has a plurality of suction holes 52. The outer ends of the suction holes 52 are open at the bottoms of two of the four groove-parts 50, while the inner ends of the suction holes 52 are open at the inner circumferential face of the drum shell 40.

For more detailed explanation, attention will be focused on the arrangement of suction holes 52 in two transport grooves 48 adjacent to each other in the circumferential direction of the drum shell 40.

Figure 5:
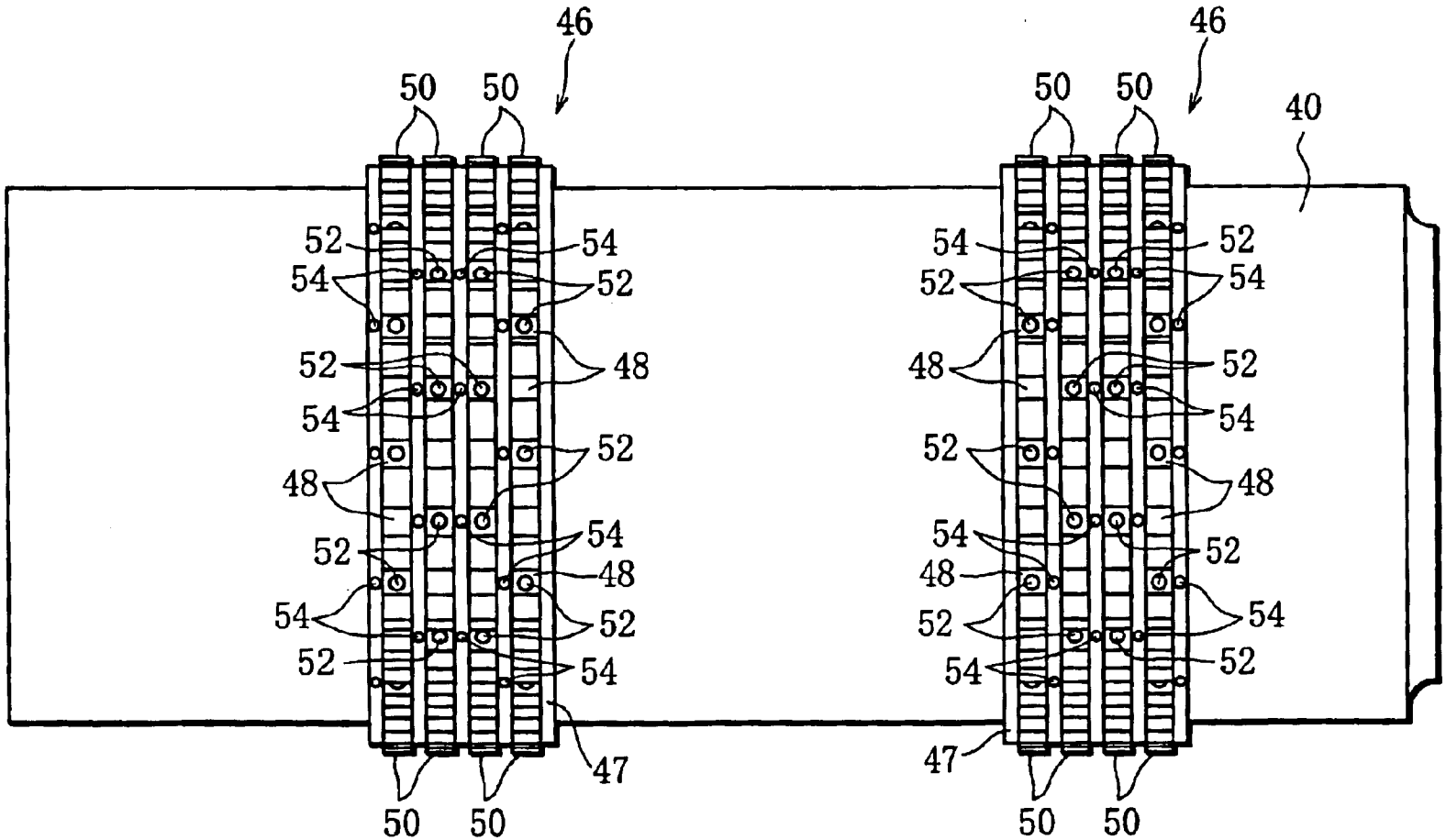
FIG. 5 is an illustration showing the outer circumferential surface of a drum shell of the removing drum.
Figure 6:
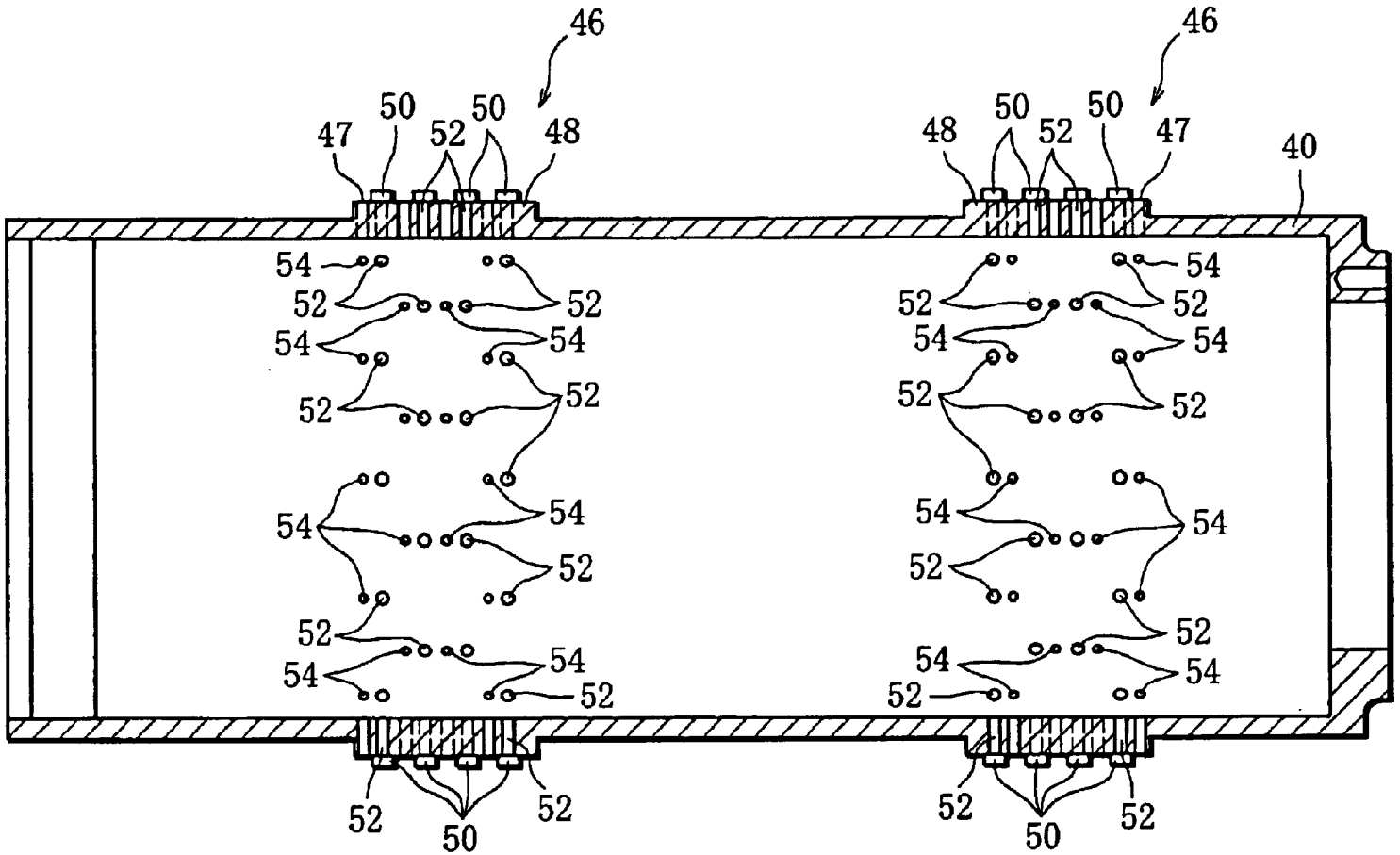
FIG. 6 is a longitudinal cross-sectional view of the drum shell of FIG. 5.

As seen from FIGS. 5 and 6, one of two adjacent transport grooves 48 is formed as a first-type transport groove which has suction holes 52 in the two groove-parts 50 located in the middle, while the other is formed as a second-type transport groove which has suction holes 52 in the two groove-parts 50 located at the opposite sides. Thus, first-type transport grooves 48 and second-type transport grooves 48 are alternated in the circumferential direction of the drum shell 40, and the suction holes 52 of the first-type transport grooves 48 and the suction holes 52 of the second-type transport grooves 48 are at different axial positions with reference to the drum shell 40, or in other words, at different lengthwise positions with reference to the transport grooves 48. Thus, the suction holes 52 of the first-type grooves 48 do not exist on the same circumferences of the drum shell 40 as the suction holes 52 of the second-type grooves 48 exist on.

Each transport groove 48 has also two eject holes 54. In one-type transport grooves, the outer ends of the two eject holes 54 are open at the transport groove 48. In the other-type transport grooves, the outer end of one of the two eject holes 54 is open at the transport groove 48, while the other is open near the transport groove 48, namely, at an edge part of the rib 47. The inner ends of the eject holes 54 are open at the inner circumferential surface of the drum shell 40.

More specifically, in FIGS. 5 and 6, in the right-hand transport groove row 46, the two eject holes 54 of each of the first-type and second-type transport grooves 48 are located adjacent to the corresponding suction hole 52 at right side thereof on the rib 47. In the left-hand transport groove row 46, the two spurt holes 54 of each of the first-type and second-type transport grooves 48 are located adjacent to the corresponding suction hole 52 at left side thereof on the rib 47. Hence, like the suction holes 52, the eject holes 54 of the first-type transport grooves 48 and the eject holes 54 of the second-type transport grooves 48 are at different axial positions with reference to the drum shell 40.

As shown in FIGS. 3 and 4, a negative pressure chamber 56 is defined between the outer sleeve 38 and the inner sleeve 40, and a passage 58 is formed in the inner sleeve 30. The passage 58 is connected to the negative pressure chamber 46, and also connected to a suction passage 60 formed in the frame 36.

As shown in FIG. 4, the outer sleeve 38 has two slot groups corresponding to the left-hand and right-hand transport groove rows 46. Each of the two slot groups has four suction slots 62, which are associated with the suction holes 52 in the corresponding one of the transport groove rows to supply suction pressure to them. More specifically, each suction slot 62 is constantly connected to the negative pressure chamber 56 and, the outer end of each suction slot 62 is open at the outer circumferential surface of the outer sleeve 38 so that each suction slot can supply suction pressure to its associated suction holes 52.

Each suction slot 62 extends in the direction in which the removing drum 24 rotates, from the point where the removing drum 24 and the transport drum immediately upstream thereof are closest to each other, to just before the point where the removing drum 24 and the transport drum immediately downstream thereof are closest to each other. The region where suction pressure is supplied to the suction slots 62 is indicated with "suction supply region" in FIG. 3.

When the removing drum 24, specifically, the drum shell 40 rotates and two transport grooves 48, namely a transport groove 48 in the left-hand transport groove row 46 and a transport groove 48 in the right-hand transport groove row 46 reach the transport drum immediately upstream of the removing drum 24, the suction holes 52 of these two transport grooves are connected to their associated suction slots 62. As a result, suction pressure is supplied to the two transport grooves 48 from the negative pressure chamber 56 through the suction slots 62 and the suction holes 52. Hence, the two transport grooves 48 suck and thereby receive two filter cigarettes FC from the transport drum immediately upstream. In other words, two filter cigarettes FC are transferred from the transport drum immediately upstream to the removing drum 24, and transported by rotation of the removing drum 24.

After the transport grooves 48 which have received the filter cigarettes FC pass through the suction supply region, and then reach the position immediately before the transport drum immediately downstream of the removing drum, the suction holes 52 of these transport grooves 48 are connected to a release groove 64 (FIG. 3). The release groove 64 is formed in the outer circumferential surface of the outer sleeve 38, and open to the atmosphere at the opposite end faces of the outer sleeve 38.

Hence, when the transport grooves 48 come in the region of the release groove 64, the suction pressure in the transport grooves 48 is released, and the filter cigarettes FC in the transport grooves 48 are received in transport grooves of the transport drum immediately downstream, by suction. In other words, the filter cigarettes FC are transferred from the removing drum to the transport drum immediately downstream, which transports the filter cigarettes FC in the downstream thereof.

Not only the above-mentioned transport drums immediately upstream and downstream of the removing drum but also the other transport drums have transport grooves, and the supply of suction pressure to the transport grooves thereof is controlled in the same way. Hence, these transport drums transport rod-like articles such as cigarette rods, cigarettes, double filter cigarettes and filter cigarettes in the same way, where the rod-like articles are transferred between adjacent transport drums.

The suction supply region is severed by a pair of first suction holding regions A and B (see FIG. 3). The first suction holding regions A and B are apart from each other in the circumferential direction of the removing drum 24.

The first and second suction holding regions A and B are provided for the left-hand and right-hand transport groove rows 46, respectively. The first suction holding region A located upstream the regions B is provided to remove defective filter cigarettes FC from the removing drum 24, while the second suction holding region B is provided to pick up filter cigarettes FC from the removing drum 24 for sampling.

Since the first and second suction holding regions A and B are all similar in structure, only the first suction holding region A will be explained.

Figure 7:
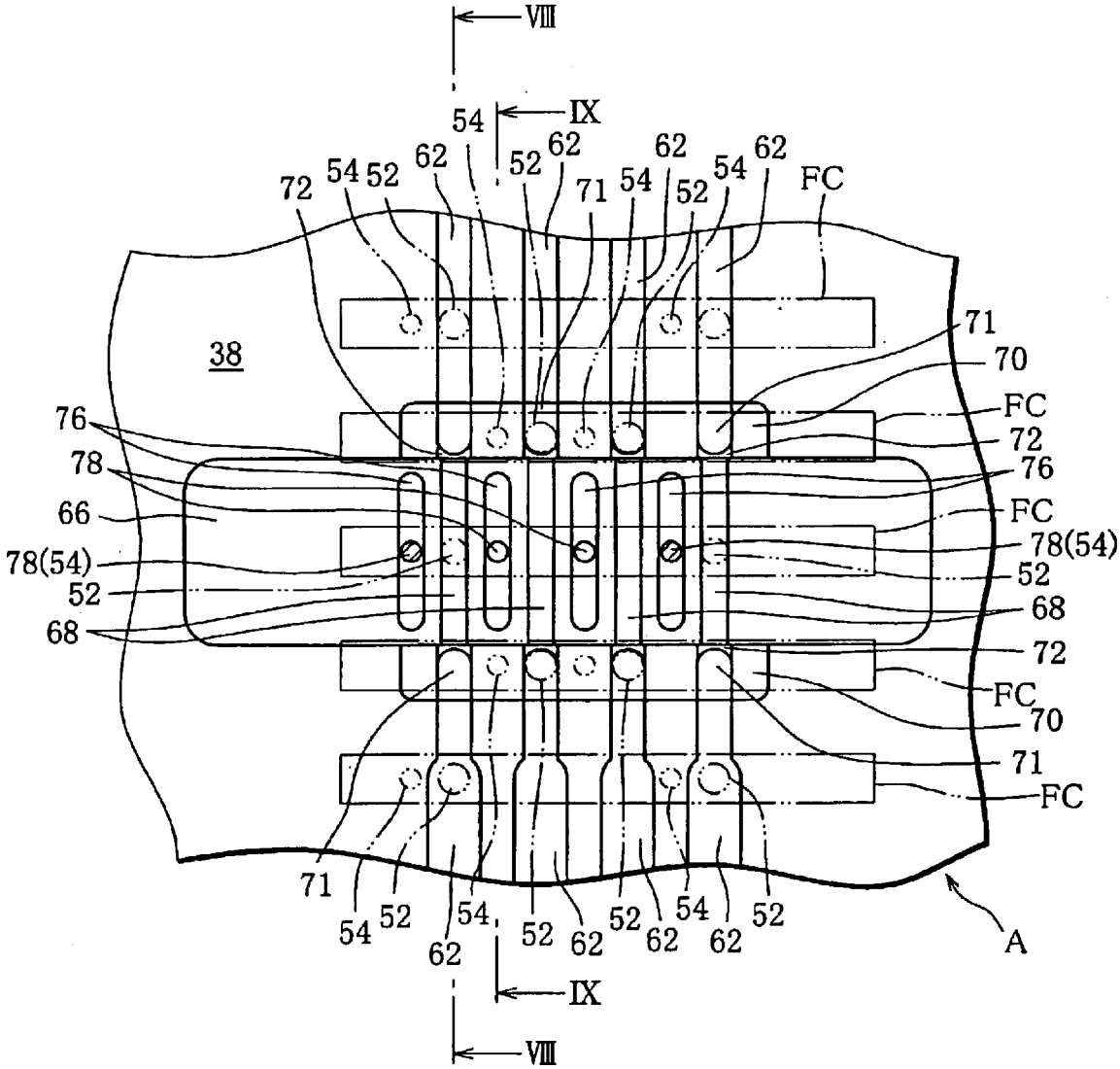
FIG. 7 is a developed view showing the outer circumferential surface of an outer sleeve provided inside the removing drum.

FIG. 7 is a developed view of part of the outer circumferential surface of the outer sleeve 38. As seen from this developed view, the first suction holding region A includes a crossing block 66. The crossing block 66 is embedded in the outer circumferential surface of the outer sleeve 38. The outer surface of the crossing block 66 describes a circular arc and forms part of the circumferential surface of the outer sleeve 38.

The crossing block 66 extends in the axial direction of the removing drum 24, and severs the above-described four suction slots 62. Four grooves are formed in the outer surface of the crossing block 66. The four grooves extend in the circumferential direction of the outer sleeve 38, and form four independent holding passages 68 in cooperation with the inner circumferential surface of the drum shell 40. As seen from FIG. 7, the holding passages 68 are located on the same circumferential lines as the suction slots 62 are located. The holding passages 68 completely pass across the crossing block 66 and are open at the front and back end faces of the crossing block 66 as viewed in the circumferential direction of the outer sleeve 38. As viewed in the direction in which the removing drum 24 rotates, the rotation angle region in which the holding passages 68 extend is longer than the pitch between the transport grooves.

As viewed in the circumferential direction of the outer sleeve 38, immediately upstream and downstream of the crossing block 66 are arranged adjustment blocks 70, respectively. Also the adjustment blocks 70 are embedded in the outer circumferential surface of the outer sleeve 70. Like the crossing block 66, the adjustment blocks 70 each have an outer surface which forms part of the outer circumferential surface of the outer sleeve 38, and extend along the crossing block 66. The adjustment blocks 70 close the holding passages 68 at the opposite end faces of the crossing block.

Each of the adjustment blocks 70 has four connection grooves 71 formed in its outer surface. The four connection grooves 71 correspond to the four holding grooves 68 of the crossing block 66. In other words, the four connection grooves 71 are located on the same circumferential lines of the outer sleeve 38 as the four holding passages 68.

Specifically, each connection passage 71 is directly connected with its corresponding suction slot 62 to form an extension thereof, while each connection passage 71 is connected with its corresponding holding passage 68 with a throat 72 therebetween. More specifically, as seen from FIG. 8, in the outer surface of the adjustment block 70, shallows are formed to each connect a connection groove 71 and a holding passage 68. The shallow is smaller in depth than the connection groove 71, and forms the throat 72 in cooperation with the inner circumferential surface of the drum shell 40. The throat 72 is provided to reduce the area of the connection between the holding passage 68 and the connection groove 71.

Each holding passage 68 is connected with a suction slot 62 through a throat 72 and a connection groove 71. Hence, the holding passage 68 receives suction pressure from the suction slot 62, however, the suction pressure to be supplied to the holding passage 68 is reduced by the throat 72. Thus, holding pressure, which is closer to the atmospheric pressure than the suction pressure in the suction slot 62, is supplied to the holding passage 68.

Figure 8:
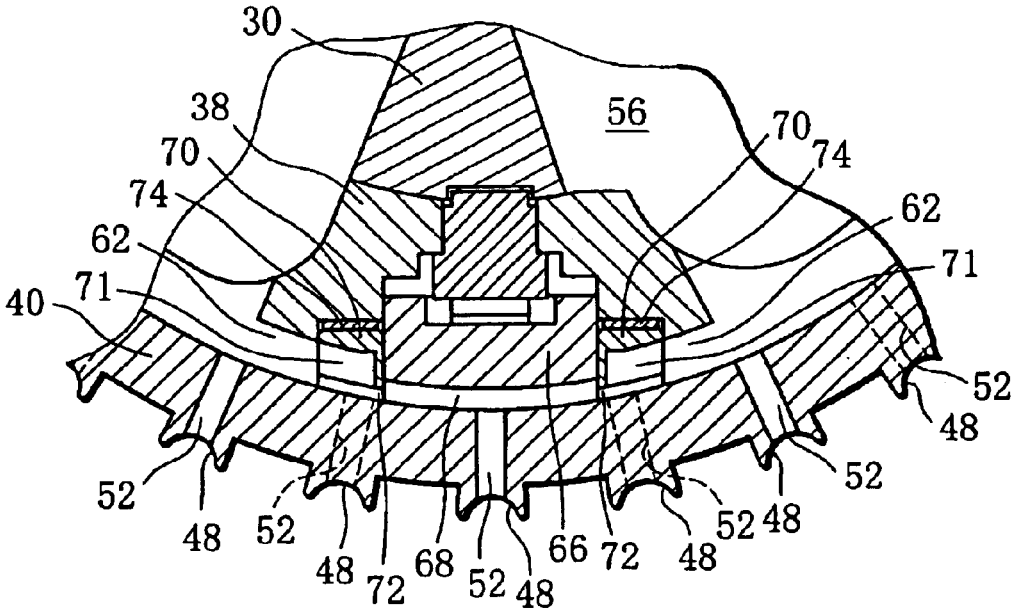
FIG. 8 is a cross-sectional view taken along line VIII—VIII of FIG. 7.

Here, it is desirable that the holding pressure in the holding passage 68 can be adjusted by changing the opening of the throat 72. Hence, adjustment blocks 70, which are different in the shallow depth, are prepared. As shown in FIG. 8, an adjustment block selected from them is fitted to the outer sleeve 38 with a shim 74 therebetween. Thus, the opening of the throat 72 is determined accurately.

As shown in FIG. 7, in the outer surface of the crossing block 66, four eject grooves 76 are also formed. The four eject grooves 76 are each associated with one of the four holding passages 68, and each extend on one side (left-hand side in FIG. 7) of its associated holding passage 68. The four eject grooves 76 are so provided that when the transport grooves 48 pass across the crossing block 66, the four eject grooves 76 are connected to the eject holes 54 of the transport grooves 48. In other words, the four eject grooves 76 are located on the lines on which the eject holes 54 pass. Hence, the four eject grooves 76 are classified into two eject grooves of a first type provided to be connected to the eject holes 54 of the first type transport grooves 48 and two eject grooves of a second type provided to be connected to the eject holes 54 of the second type transport grooves 48. Unlike the holding passages 68, the eject grooves 76 are not open at the front and back end faces of the crossing block 66.

Figure 9:
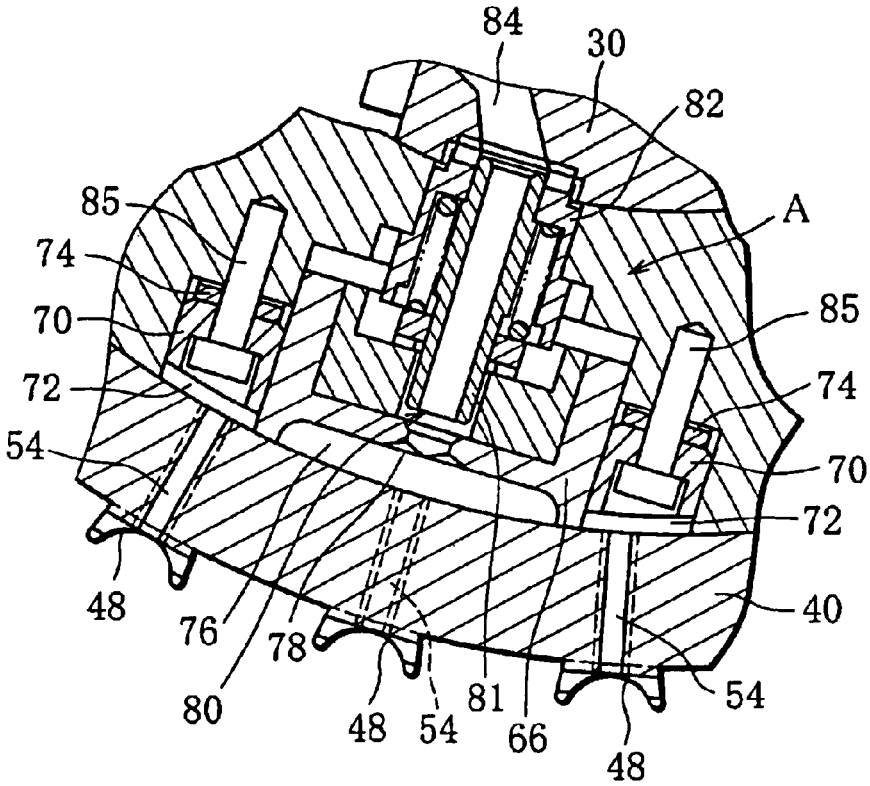
FIG. 9 is a cross-sectional view taken along line IX—IX of FIG. 7.

As shown in FIG. 9, each eject groove 76 has an ejecting port 78 which is open at the middle of the bottom thereof. For each ejecting port 78, an air nozzle 80 is provided near. Specifically, each air nozzle 80 has a hollow nozzle pipe 81. The nozzle pipe 81 is located on the axis of its associated ejecting port 78, and the distal end of the nozzle pipe 81 is located near the associated ejecting port 78. A holder 82 is attached to the proximal end of the nozzle pipe 81, and fixed to the outer sleeve 38. The proximal end of the nozzle pipe 81 is connected to an end of a connection passage 84 which extends in the inner sleeve 30. FIG. 9 also shows fixing bolts 85 for fixing the adjustment blocks 70. The fixing bolts 85 are each located between connection grooves 71.

As shown in FIG. 3, the other end of each connection passage 84 is connected to one of removing valves 88 and 90 provided for the suction holding region A through a connection tube 86. Specifically, the connection tubes 86 connected to the ejecting ports 78 of the first type eject grooves 76 are connected with the removing valve 88, while the connection tubes 86 connected to the ejecting ports 78 of the second type eject grooves 76 are connected with the removing valve 90. The removing valves 89 and 90 are solenoid-operated valves, and fixed to the inner sleeve 30 and located in the negative pressure chamber 56.

As shown in FIG. 4, the removing valves 88 and 99 are connected with a manifold 94 through coupling tubes 92. From the manifold 94 extends an inner air tube 96. The inner air tube 96 passes through the passage 58 and a connection hole 98 in the inner sleeve 30, and is connected to an outer air tube 100. The outer air tube 100 is connected to a compressed-air source.

When the removing valve 88 is opened, compressed air supplied along the described air supply route is delivered into the first type eject grooves 76 through their associated ejecting ports 78. Here, if the eject holes 54 of a first type transport groove 48 are connected with the first type eject grooves 76, the compressed air is ejected from the first type eject grooves 76 through the eject holes 54 into the first type transport groove 48. Likewise, when the removing valve 90 is opened, compressed air is delivered into the second type eject grooves 76. Here, if the eject holes 54 of a second type transport groove 48 are connected with the second type eject grooves 76, the compressed air is ejected from those eject holes 54 into the second type transport groove 48.

Figure 10:
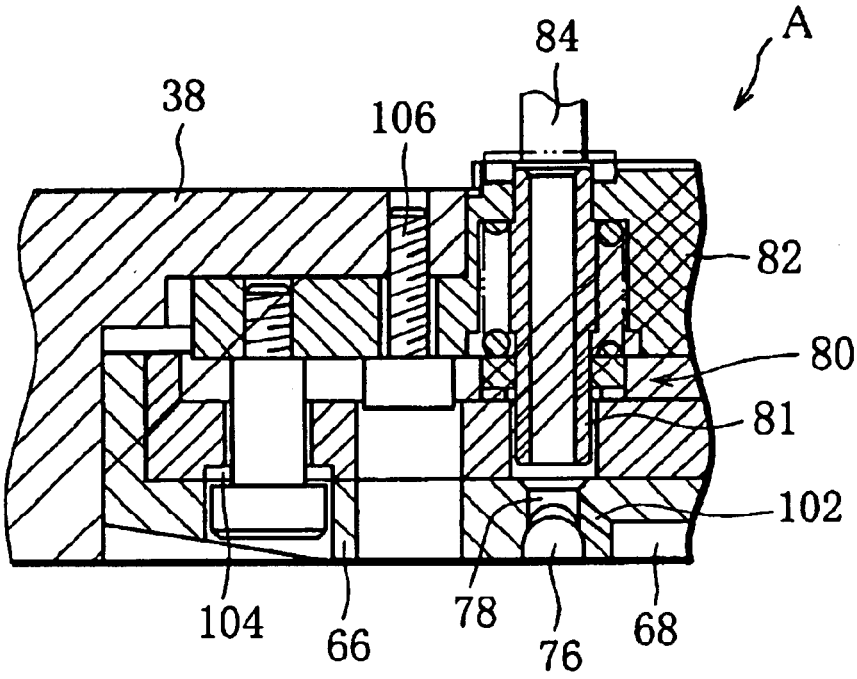
FIG. 10 is an enlarged view of part X of FIG. 4.

FIG. 10 shows an end part of the first suction holding region A as viewed in the axial direction of the removing drum 24. As seen from FIG. 10, the ejecting port 78 of each eject groove 76 is connected with an adjacent holding passage 68 through a connection hole 102, so that the compressed air delivered to the ejecting port 78 is supplied from the port 78 also to the adjacent holding passage 68. Thus, when compressed air is ejected from the eject holes 54 of a transport groove 48, compressed air is supplied also to the suction holes 52 of that transport groove 48 through the associated holding passages 68, and the holding pressure in the holding passages 68 is negated by the compressed air thus supplied.

FIG. 10 also shows fixing bolts 104, 106 for fixing the crossing block 66 and the holder 82 for the air nozzles 80 to the outer sleeve 38.

Suppose that a defective filter cigarette FC, which had been detected as defective on the inspection drum located upstream of the removing drum 24, has been transferred to the removing drum 24. The transport groove 48 which has received this defective filter cigarette FC will be hereinafter referred to as a targeted transport groove. Of the removing valves 88 and 90, the one which is associated with the targeted transport groove is opened at the time the targeted transport groove 48 reaches the first suction holding region A. Therefore, in the first suction holding region A, compressed air is supplied to the eject grooves 76 and the holding passages 68 which are associated with the targeted transport groove, so that the holding pressure in those holding passages 68 is negated by the supplied compressed air.

At about the same time that the compressed air is supplied as described above, the targeted transport groove 48 comes in the first suction holding region A, and the eject holes 54 of the targeted transport groove 48 are connected with the associated eject grooves 76. At this time, the compressed air in the eject grooves 76 and the holding passages 68 is ejected into the eject holes 54 and the suction holes 52. The ejection of compressed air blows the defective filter cigarette FC off the targeted transport groove 48. Thus, the defective filter cigarette FC is surely removed from the removing drum 24. The removed filter cigarette FC is brought into a waste box (not shown).

As seen from FIG. 7, as viewed in the circumferential direction of the outer sleeve 38, the first suction holding region A, more specifically, the eject grooves 76 thereof are longer than the pitch between the transport grooves 48. Since the time required for the targeted transport groove to pass through the eject grooves 76 is correspondingly long, desired compressed-air pressure, or desired removing pressure can be raised in the eject grooves 78 within this period of time. Hence, response delay in raising the removing pressure dose not apper, and the defective filter cigarette FC can be surely removed.

As already mentioned, when the first suction holding region A is long, the region A allows two filter cigarettes FC to enter into the first suction holding region A at the same time, as seen from FIG. 7. However, even if one of the two filter cigarettes FC is defective and the other is non-defective, the defective filter cigarette FC alone can be surely removed in the first suction holding region A.

Specifically, in the first suction holding region A, the holding passages 68 are formed to be independent from each other. Hence, when the defective filter cigarette FC is removed in the above-described manner, the compressed air used for removing the defective filter cigarette FC has no effect on the non-targeted transport groove 48 which holds the non-defective filter cigarette FC, more specifically, on the holding passages 68 associated with the non-targeted transport groove 48.

As a result, the suction holes 52 of the non-targeted transport groove can surely receive holding pressure from the holding passages 68 associated with them, so that the non-defective filter cigarette FC passes through the first suction holding region A, being stably held in the non-targeted transport groove 48. In FIG. 7, the eject holes 54 to which compressed air is ejected are marked with hatching.

When an empty transport groove 48 which has not received a filter cigarette FC comes in the first suction holding region A and the suction holes 52 of the empty transport groove 48 are connected with the associated holding passages 68, the pressure in those associated holding passages 68 increases to the atmospheric pressure. However, since the holding passages 68 are independent from each other as mentioned above, pressures in all the holding passages 68 do not increase to the atmospheric pressure at the same time. Hence, the transport grooves 48 before and after the empty transport groove 48 can surely receive holding pressure from their associated holding passages 68 through their suction holes 52, and pass through the first suction holding region A, stably holding filter cigarettes FC.

Also when a transport groove 48 with a filter cigarette, which is between empty two transport grooves 48, comes in the first suction holding region A, the transport groove 48 between the empty transport grooves 48 can stably hold a filter cigarette for the same reason as above.

As shown in FIG. 8, since the negative pressure chamber 56 to which the suction slots 62 and the connection grooves 71 are connected has a sufficient volume, the suction pressure in the suction slots 62 and the connection grooves 71 does not decrease rapidly even when an empty transport groove 48 passes through the first suction holding region A. This contributes to stable transport of filter cigarettes FC.

The holding pressure in the holding passages 68 are made weaker than the suction pressure in the suction slots 62 by the throats 72 (see FIG. 8). This allows the removing pressure for removing defective filter cigarettes to be satisfactorily low.

When the removing pressure is high, the compressed air flows around a filter cigarette FC and tends to force the filter FC cigarette back into the targeted transport groove 48. Thus, high removing pressure leads to unstable removing of filter cigarettes FC.

Further, when the removing pressure is high, compressed air can flow into the suction slots 62. In that case, in the transport grooves 48 before and after the targeted transport groove 48, filter cigarettes FC cannot be held stably.

In the second suction holding region B, filter cigarettes can be removed, or picked up from the transport grooves 48 for sampling in the same manner as in the first suction holding region A.

The invention is not limited to the above-described embodiment. Various modifications can be made to it.

For example, the holding passages and eject grooves may be independently provided for three successive transport grooves as viewed in the circumferential direction of the removing drum 24.

Compressed air may be supplied to the eject grooves 76 alone or the holding passages 68 alone. If compressed air is supplied to the holding passages 68 alone, the transport grooves 76 do not need to have eject holes 54, Further, the application of the removing apparatus according to the invention is not limited to the filter cigarette manufacturing machine. It can be applied to rejection or sampling of other rod-like articles such as cigarette-filters in like manner.

What is claimed is:

1. A removing apparatus for rod-like articles, comprising:

a rotatable removing drum forming part of a transport path for the rod-like articles, said removing drum having a plurality of transport grooves for each receiving a rod-like article, the transport grooves being arranged at an outer circumferential surface of said removing drum with equal spaces therebetween in a circumferential direction of said removing-drum and each having a suction hole, where the suction holes of adjacent transport grooves in the circumferential direction of said removing drum are located at different axial positions thereof, so that the transport grooves are classified into a plurality of transport-groove types according to the axial position of the suction hole;

a suction means including a suction supply region extending in the circumferential direction of said removing drum, for supplying suction pressure to the transport grooves through the suction holes thereof while the transport grooves are passing through the suction supply region during the rotation of said removing drum, to hold rod-like articles in the transport grooves by suction;

a suction holding region for severing the suction supply region, said suction holding region including a plurality of independent holding passages each associated with one of the transport-groove types and arranged in parallel with each other, each of the holding passages extending longer in the circumferential direction of said removing drum than a distance between the transport grooves and being connected to the suction hole of a corresponding transport groove for supplying a predetermined holding pressure to the corresponding transport groove to hold suction of the rod-like article in the corresponding transport groove while the corresponding transport groove is passing through the suction holding region; and a compressed air ejecting means for selectively removing the rod-like article from the corresponding transport groove by compressed air while the corresponding transport groove is passing through the suction holding region, said compressed air ejecting means including a plurality of independent supply passages each associated with one of the transport-groove types, the supply passages allowing compressed air to be supplied to a corresponding transport groove while the corresponding transport groove is passing through the suction holding region, to thereby negate suction of the rod-like article in the corresponding transport groove, and solenoid-operated valves for opening and closing the supply passages, respectively.

2. The removing apparatus according to claim 1, wherein, said removing drum includes a stationary sleeve member having the suction holding region on an outer circumferential surface thereof, and a drum shell rotatably mounted on the outer circumferential surface of the stationary sleeve member and having the transport grooves.

3. The removing apparatus according to claim 2, wherein, the supply passages are each connected with the holding passage associated with the same transport-groove type.

4. The removing apparatus according to claim 2, wherein, said compressed air ejecting means includes ejecting holes provided for the transport grooves, the ejecting holes being located at different axial positions of transport grooves depending on the transport-groove types, and a plurality of independent ejecting grooves each associated with one of the transport-groove types and extending in parallel with the holding passages in the suction holding region, each of the ejecting grooves being connected to the eject hole of a corresponding transport groove while the corresponding transport groove is passing through the suction holding region, and connected with the supply passage associated with the same transport-groove type.

5. The removing apparatus according to claim 4, wherein, said compressed air ejecting means further includes connection holes each connecting the holding passage and the ejecting groove associated with the same transport-groove type.

6. The removing apparatus according to claim 2, wherein, said suction means includes a plurality of suction slots formed in the outer circumferential surface of the stationary sleeve member, the suction slots extending in the suction supply region and being connectable with the suction holes of the transport grooves, and the suction holding region further includes connection passages connecting each of the holding passages with an associated one of the suction slots.

7. The removing apparatus according to claim 6, wherein each of the connection passages has a throat for determining holding pressure in the associated holding passage.

8. The removing apparatus according to claim 2, wherein, said removing drum forms part of a transport path in a filter cigarette manufacturing machine, and is provided for removing cigarettes, double filter cigarettes or filter cigarettes transported along the transport path as rod-like articles.

* * * * *